US007520775B2

(12) United States Patent
Wu et al.

(10) Patent No.: US 7,520,775 B2
(45) Date of Patent: Apr. 21, 2009

(54) JUMPER DEVICE

(75) Inventors: Hung-Yi Wu, Taipei Hsien (TW); Zheng-Heng Sun, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/842,164

(22) Filed: Aug. 21, 2007

(65) Prior Publication Data

US 2008/0194138 A1 Aug. 14, 2008

(30) Foreign Application Priority Data

Feb. 9, 2007 (CN) ..... 2007 1 0200181

(51) Int. Cl.
*H01R 13/08* (2006.01)

(52) U.S. Cl. ..... 439/507; 200/292; 200/16 C

(58) Field of Classification Search ..... 439/507, 439/512, 513, 509, 52, 510; 338/161; 200/16 C, 200/292, 16 A, 16 R
See application file for complete search history.

(56) References Cited

U.S. PATENT DOCUMENTS 4,417,107 A * 11/1983 Terajima ..... 200/16 C
6,191,373 B1 * 2/2001 Liao ..... 200/16 A
2006/0121778 A1 6/2006 Huang

* cited by examiner

*Primary Examiner*—Neil Abrams
*Assistant Examiner*—Phuong Nguyen
(74) *Attorney, Agent, or Firm*—Frank R. Niranjan

(57) ABSTRACT

A jumper device configured for adjusting connections between a plurality of pins of a jumper block on a mainboard is provided. In a preferred embodiment, the jumper device (10) includes a casing (11), a plurality of conductive members (13), and a switch (12). The casing has a plurality of slots (112) defined therein and communicate with outside at the bottom of the casing, and a sliding groove (113) communicates the top of the slots. The conductive members disposed in the corresponding slots and configured for electrically connecting with the corresponding pins (41, 42, 43) of the jumper block (40). The switch (12) slidably disposed in the sliding groove (113) and is capable of selectively connecting two of the conductive members to connect two corresponding pins of the jumper block.

15 Claims, 7 Drawing Sheets

JUMPER DEVICE

BACKGROUND

1. Field of the Invention

The present invention relates to a jumper device, which is capable of conveniently controlling connection of pins of electrical devices on a mainboard.

2. Description of Related Art

In electronics and particularly computing, a jumper is a short length of conductor used to close a break in or bypass part of an electrical circuit. Jumpers are typically used to set up or adjust printed circuit boards, such as the mainboard of computers. Jumper pins (points to be connected by the jumper) are arranged in groups called jumper blocks, each group having at least one pair of contact points and often more. In general, each contact in a jumper block terminates in a small metal pin. An appropriately sized conductive sleeve called a jumper, or more technically, a jumper shunt, is slipped over the pins to complete the circuit. FIG. 7 is a schematic illustration showing a conventional jumper 20. The jumper 20 is used to slip over a jumper block 30 of a mainboard 100. The jumper block 30 has a plurality of pins 31, 32, 33, which are electrically connected to electrical devices (not shown). When the jumper 20 is slipped over the jumper block 30, two pins of the jumper block 30 are connected to each other to form a closed circuit (ON state). Therefore, a current may flow between the two pins. On the contrary, when the jumper 20 is not slipped over the jumper block 30, the two pins are an open circuit (OFF state)

In general, the jumper 20 is placed in a kit package for the mainboard 100 when it is not in use. However, once the jumper 20 is removed from the mainboard 100, the jumper 20 tends to be lost and cannot easily be found because the size of the jumper 20 is very small, which will bring inconvenience to the user.

What is needed, therefore, is a jumper device to solve the above-mentioned problem.

SUMMARY

An exemplary jumper device includes a casing, a plurality of conductive members, and a switch. The casing has a plurality of slots defined therein communicating to outside at the bottom of the casing, and a sliding groove communicates the top of the slots. The conductive members disposed in the corresponding slots and configured for electrically connecting with corresponding pins of a jumper block. The switch is slidably disposed in the sliding groove, and capable of selectively connecting two of the conductive members to connect two corresponding pins of the jumper block.

Other objects, advantages and novel features of the present invention will become more apparent from the following detailed description of preferred embodiments when taken in conjunction with the accompanying drawings, in which:

DETAILED DESCRIPTION

Figure 1:
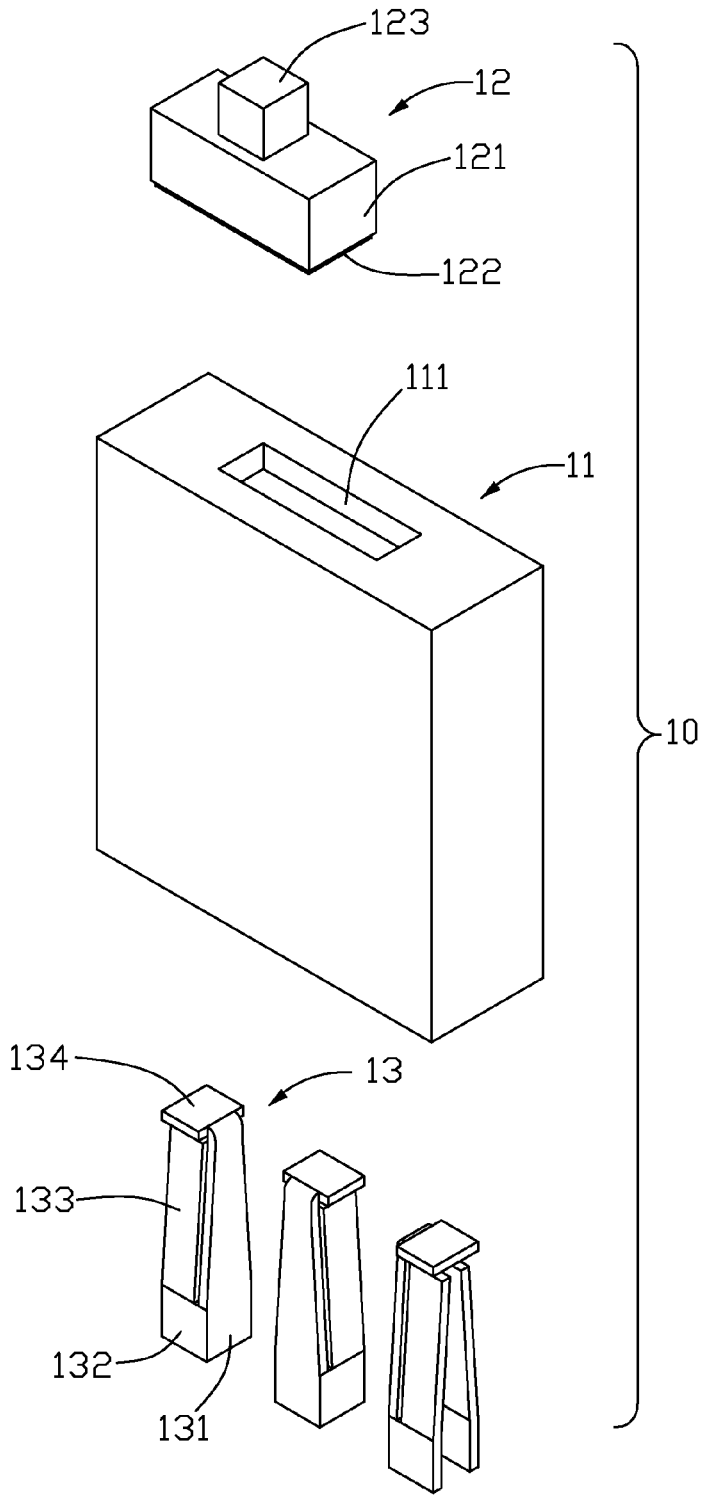
FIG. 1 is an exploded view of a jumper device, in accordance with a first embodiment of the present invention.
Figure 2:
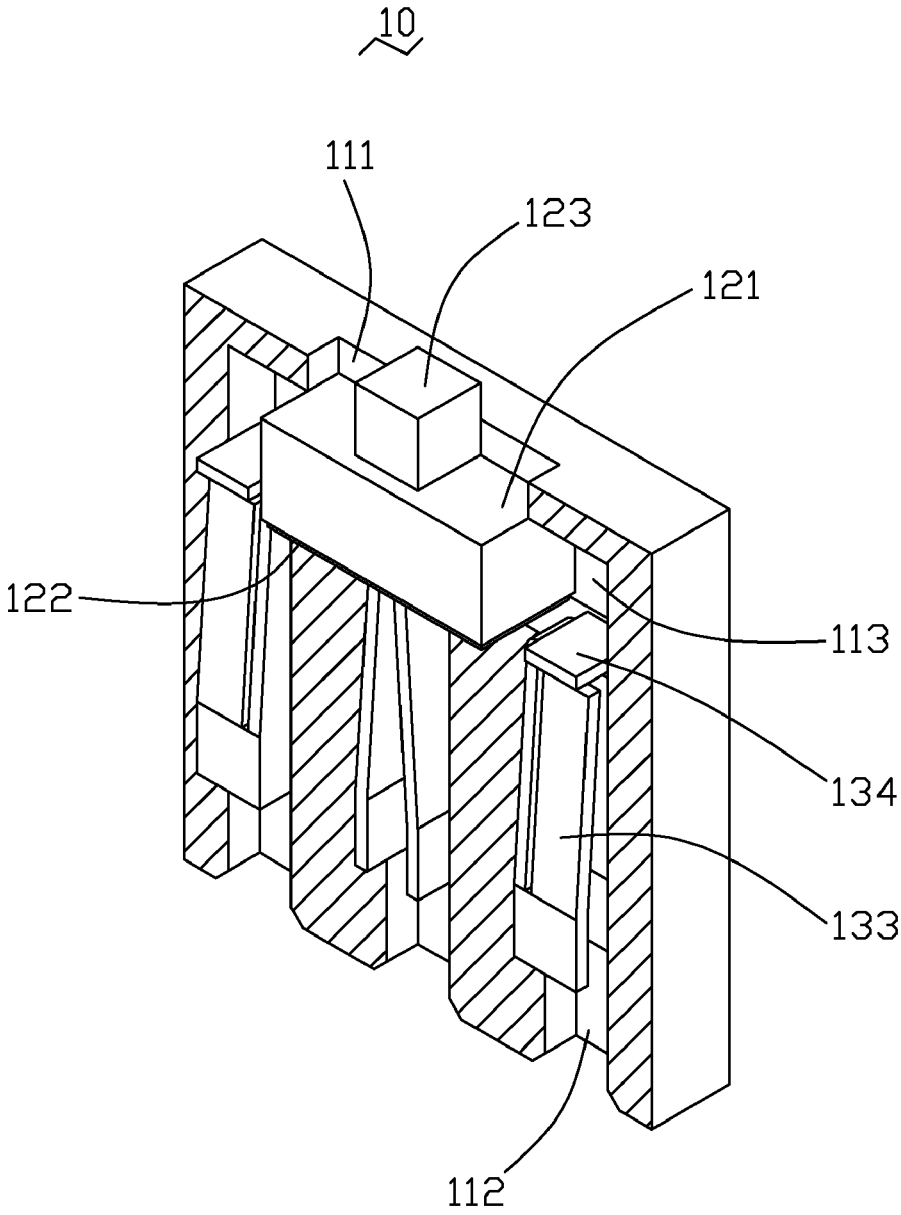
FIG. 2 is an isometric cut-away assembled view of the jumper device of FIG. 1.
Figure 3:
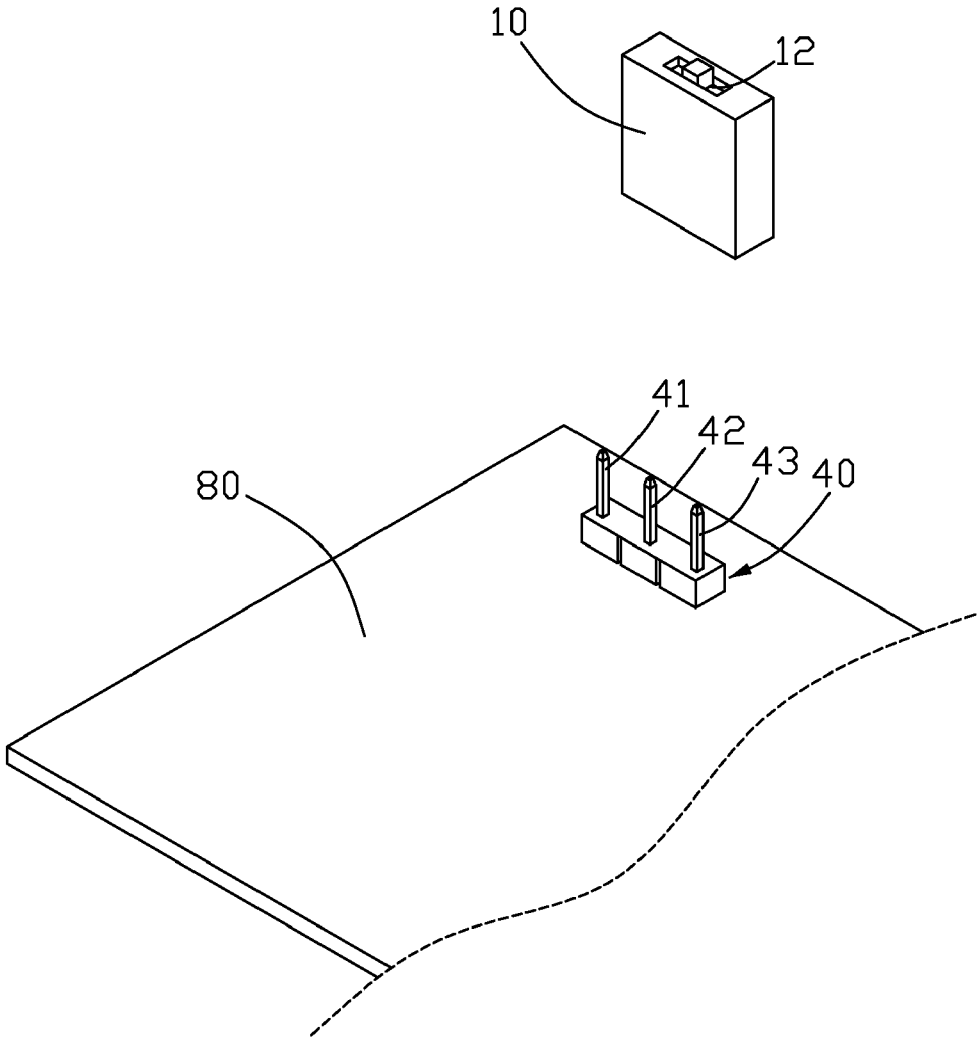
FIG. 3 is an isometric view of the jumper device of FIG. 2, together with a jumper block on a mainboard.
Figure 4:
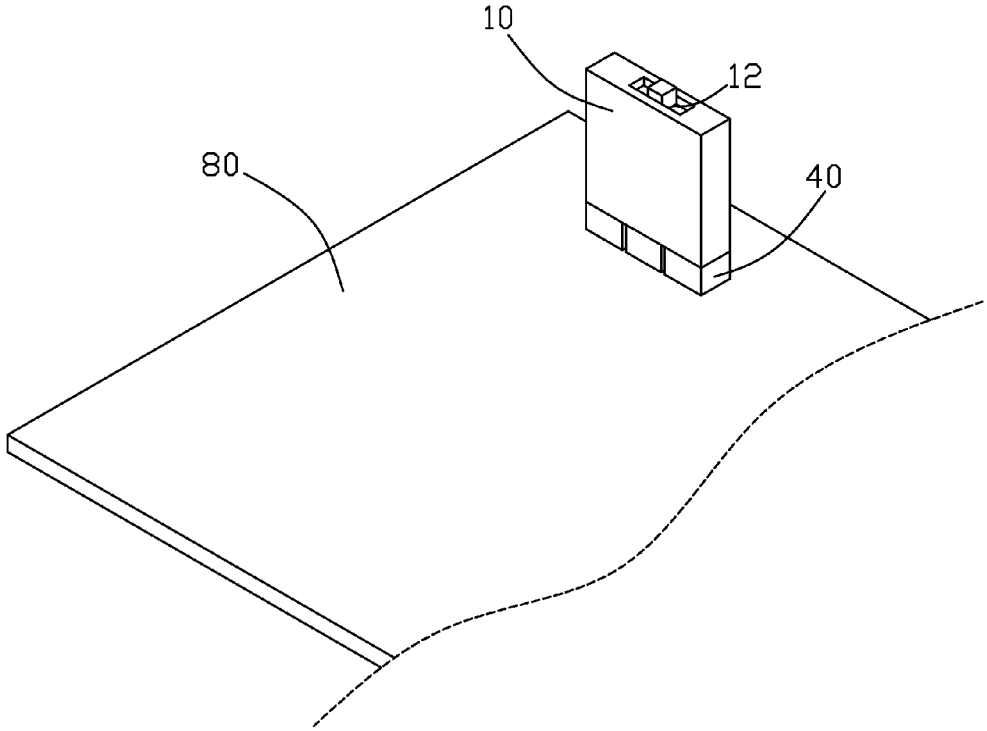
FIG. 4 is an assembled view of FIG. 3.

Referring to FIGS. 1 to 4, a jumper device 10 in accordance with a first embodiment of the present invention is provided for connecting pins of a jumper block 40 on a mainboard 80. The jumper device 10 includes a casing 11, a switch 12, and a plurality of conductive members 13. The casing 11 is rectangular-shaped and made of non-conductive material. A plurality of parallel slots 112 are defined in the casing 11 perpendicular to and exposed at a bottom of the casing 11. A sliding groove 113 is disposed at and communicates with tops of the slots 112. An opening 111 is defined in a top wall of the casing 11 in communication with the sliding groove 113.

Each conductive member 13 includes an upright connecting portion 131. Two sidewalls 132 extend perpendicularly from two opposite sides of a lower portion of the connecting portion 131 in the same direction, two elastic slices 133 extend up slantwise from the two sidewalls 132, and a top wall 134 is bent horizontally from a top edge of the connecting portion 131. Gaps are defined between the elastic slices 133 and the connecting portion 131, and the elastic slices 133 and the top wall 134, for providing elastic deformation space. The conductive members 13 are firmly fixed in the corresponding slots 112. When the jumper device 10 is slipped over the jumper block 40, the conductive members 13 clamp corresponding pins 41, 42, 43 of the jumper block 40 and assure a proper electrical connection with the pins 41, 42, 43.

The switch 12 includes a sliding block 121, a conductive sheet 122 attached at the bottom surface of the sliding block 121, and a grip handle 123 disposed at a top surface of the sliding block 121. The sliding block 121 is slidably accommodated in the sliding groove 113 with the grip handle 123 exposed from the opening 111 of the casing 11.

When in use, the jumper device 10 can remain on the jumper block 40, and connections of the pins of the jumper block 40 can be switched by moving the sliding block 121 to different positions. For example, when the grip handle 123 is moved all the way to the left, the sliding block 121 connects the left one and the middle one of the conductive members 13, thereby connecting the pins 41, 42 of the jumper block 40; when the grip handle 123 is moved all the way to the right, the sliding block 121 connects the middle one and the right one of the conductive members 13, thereby connecting the pins 42, 43 of the jumper block 40; when the grip handle 123 is moved to the middle, the sliding block 121 only connects with the middle one of the conductive members 13.

Figure 5:
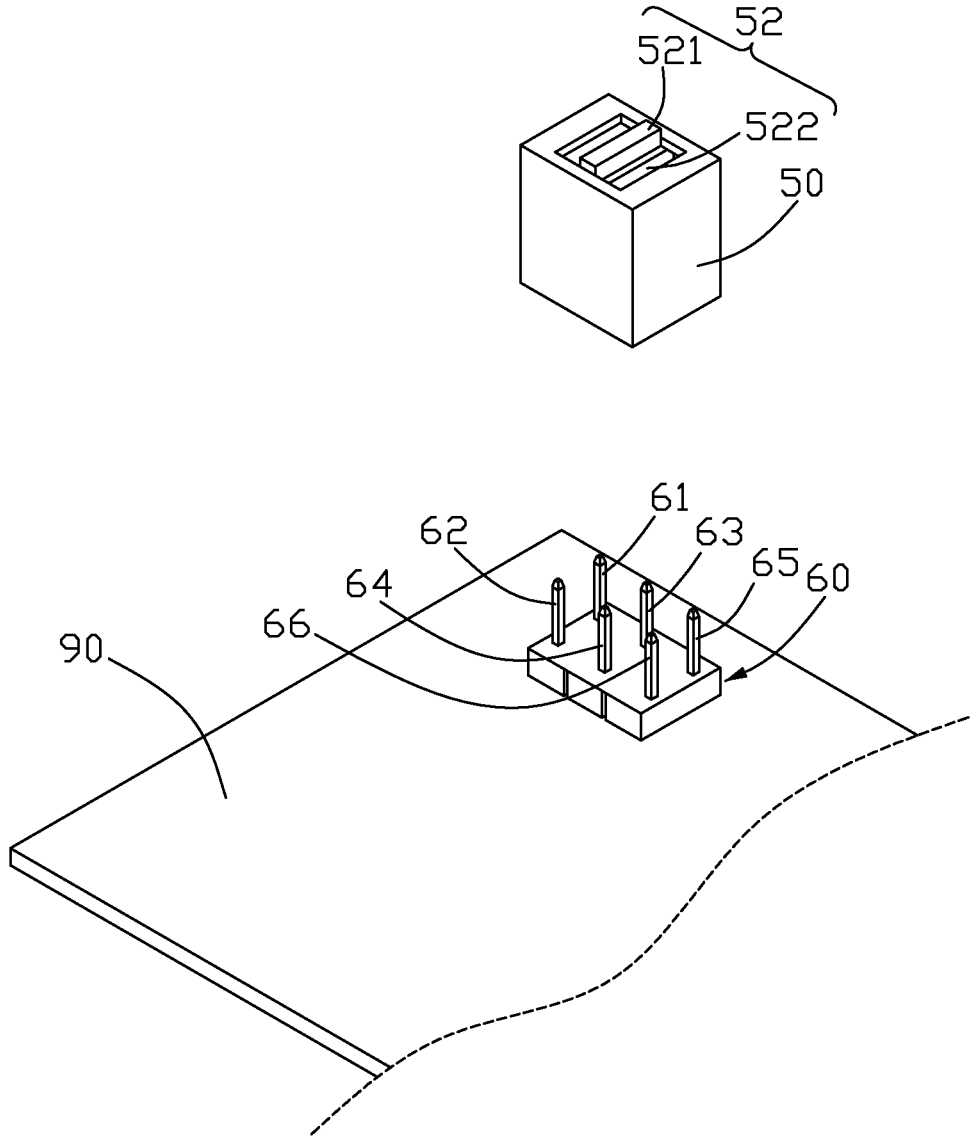
FIG. 5 is an isometric view of a jumper device together with a jumper block on a mainboard, in accordance with a second embodiment of the present invention.
Figure 6:
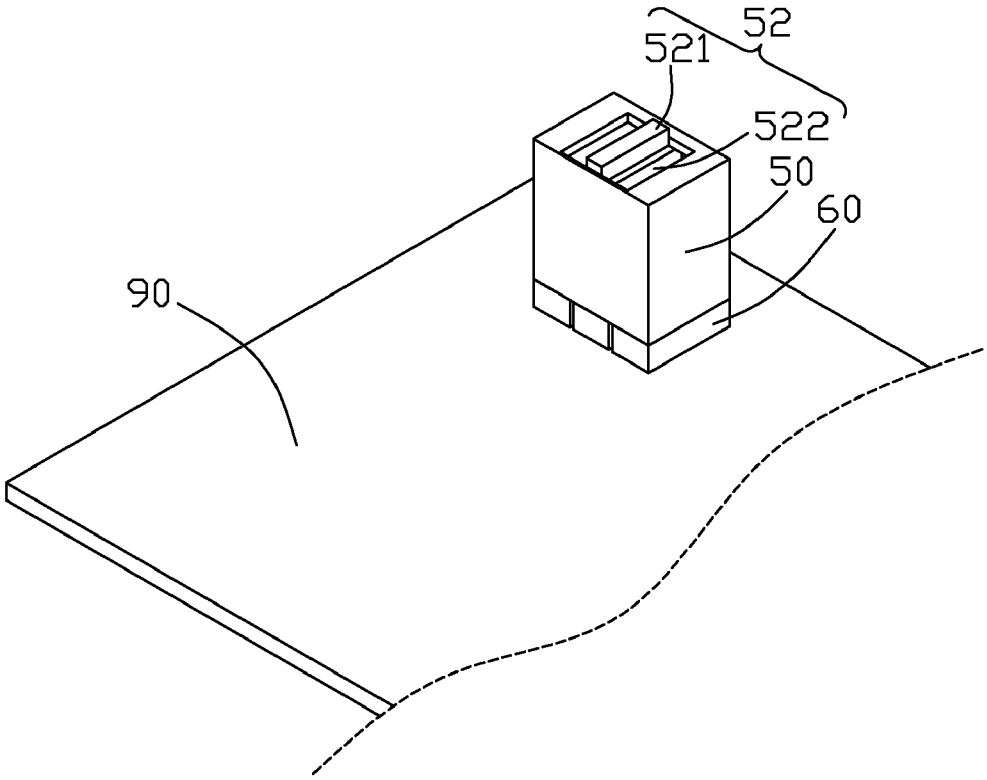
FIG. 6 is an assembled view of FIG. 5.
Figure 7:
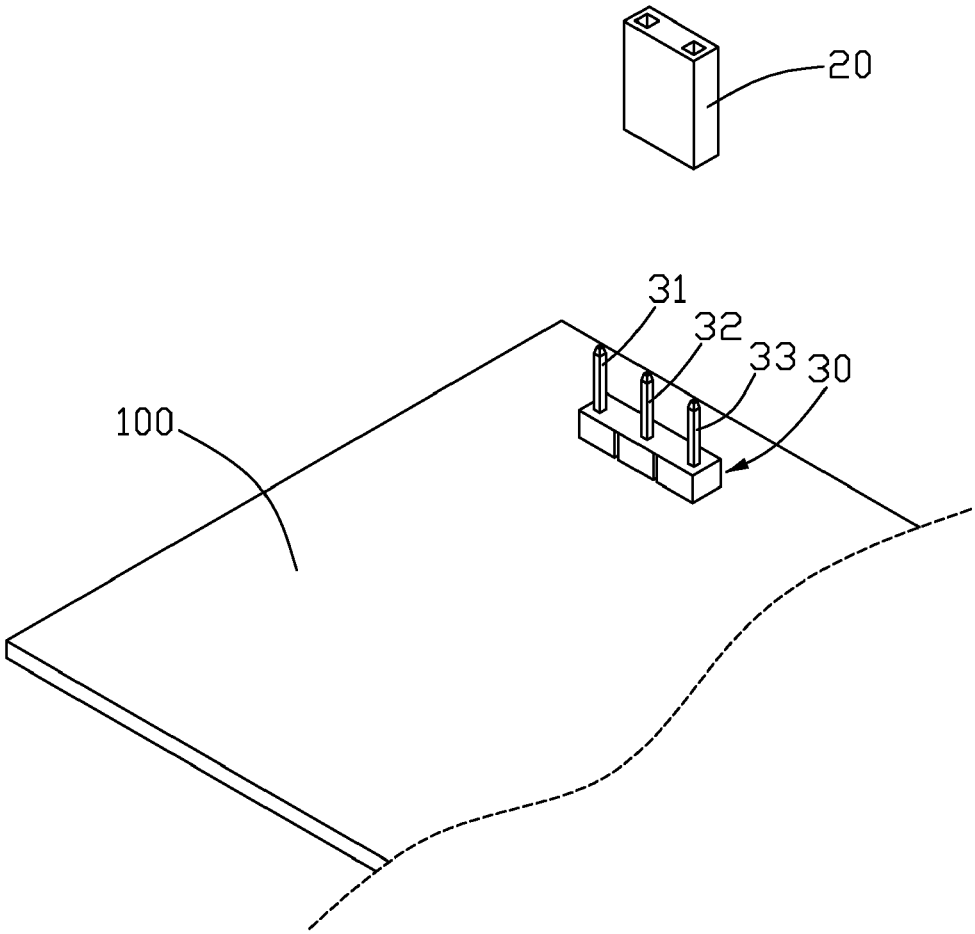
FIG. 7 (RELATED ART)
FIG. 7 is an isometric view of a conventional jumper device together with a jumper block on a mainboard.

Referring to FIG. 5 and FIG. 6, a jumper device 50 in accordance with a second embodiment of the present invention is used to connect pins of a jumper block 60 on a mainboard 90. The jumper block 60 includes six pins 61~66 arranged in a 2×3 array. The jumper device 50 defines six conductive members (not shown) fixed in six slots (not shown) therein corresponding to the pins 61~66 of the jumper block 60. The jumper device 50 includes a switch 52, the switch 52 has a grip handle 521, an elongated sliding block 522, and a conductive sheet (not shown) attached at the bottom surface of the sliding block 522. When the grip handle 521 is moved all the way to the left, the left pair of pins 61, 62 of the jumper block 60 is connected; When the grip handle 521 is moved to the middle, the middle pair of pins 63, 64 of the jumper block 60 is connected; when the grip handle 521 is moved all the way to the right, the right pair of pins 63, 64 of the jumper block 60 is connected.

In the above embodiments, users can conveniently change connections of pins of the jumper block by driving the grip handle to slide the sliding block to different positions. Therefore, when the jumper is not needed, it can remain in place with the switch at a predetermined neutral position. Thus, the user does not have to worry about the loss of the jumper device.

The foregoing description of the exemplary embodiment of the invention has been presented only for the purposes of illustration and description and is not intended to be exhaustive or to limit the invention to the precise forms disclosed. Many modifications and variations are possible in light of the above teaching. The embodiment was chosen and described in order to explain the principles of the invention and its practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiment described therein.

What is claimed is:

1. A jumper device configured for adjusting connections between a plurality of pins of a jumper block on a mainboard, comprising:

a non-conductive casing having a plurality of slots defined therein perpendicular to and exposed at a bottom of the casing, and a sliding groove communicating with and perpendicular to tops of the slots;

a plurality of conductive members each disposed in corresponding one of the slots and configured for electrically connecting with corresponding pins of the jumper block; and a switch slidably disposed in the sliding groove configured for selectively connecting two adjacent conductive members to thereby electrically connect two corresponding adjacent pins of the jumper block;

wherein an opening is defined in a top wall of the casing in communication with the sliding groove configured to expose the switch, the switch comprises a sliding block, a conductive sheet attached at a bottom surface of the sliding block, and a grip handle disposed at a top surface of the sliding block, the sliding block is slidably accommodated in the sliding groove with the grip handle exposed from the opening of the casing.

2. The jumper device as claimed in claim 1, wherein each of the conductive members comprises an upright connecting portion, two sidewalls extending perpendicularly from two sides of a lower portion of the connecting portion in the same direction, two elastic slices extending up slantwise from the two sidewalls, and a top wall bent horizontally from a top edge of the connecting portion.

3. The jumper device as claimed in claim 1, wherein the top of the slots of the casing are arranged in a line, the switch is movable along the line to selectively connect the conductive members at two adjacent slots of the casing.

4. The jumper device as claimed in claim 1, wherein the slots of the casing are arranged in a matrix of two rows by N columns, where N is a natural number equal to the number of slots divided by two, the switch is movable to selectively connect conductive members of any one of the N columns.

5. A jumper device configured for adjusting connections between a plurality of pins of a jumper block on a mainboard, comprising:

a non-conductive casing having a plurality of slots defined therein perpendicular to and exposed at a bottom of the casing, and a sliding groove communicating with and perpendicular to tops of the slots, the slots configured for accommodating corresponding pins of the jumper block respectively;

a switch comprising a conductive sheet slidably disposed in the sliding groove, the switch being slidable along the sliding groove to allow the conductive sheet of the switch selectively electrically connecting two corresponding adjacent pins of the jumper block.

6. The jumper device as claimed in claim 5, wherein the switch further comprises a sliding block, and a grip handle disposed at a top surface of the sliding block, the conductive sheet is attached at a bottom surface of the sliding block, an opening is defined in a top wall of the casing in communication with the sliding groove, and the sliding block is slidably accommodated in the sliding groove with the grip handle exposed from the opening of the casing.

7. The jumper device as claimed in claim 5, further comprising a plurality of conductive members disposed in the corresponding slots and configured for electrically connecting with the corresponding pins of the jumper block, the conductive sheet of the switch capable of selectively connecting two of the conductive members to thereby electrically connect two corresponding pins of the jumper block.

8. The jumper device as claimed in claim 7, wherein each of the conductive members comprises an upright connecting portion, two sidewalls extending perpendicularly from two sides of a lower portion of the connecting portion in the same direction, two elastic slices extending up slantwise from the two sidewalls, and a top wall bent horizontally from a top edge of the connecting portion.

9. The jumper device as claimed in claim 7, wherein the top of the slots of the casing are arranged in a line, the switch is movable along the line to selectively connect the conductive members at two adjacent slots of the casing.

10. The jumper device as claimed in claim 7, wherein the slots of the casing are arranged in matrix of two rows by N columns, where N is a natural number equal to the number of slots divided by two, the switch is movable to selectively connect conductive members of any one of the N columns.

11. A jumper device assembly comprising:

a jumper block mounted on a mainboard, comprising a plurality of pins;

a non-conductive casing comprising a plurality of slots defined therein perpendicular to and exposed at a bottom of the casing, and a sliding groove communicating with and perpendicular to the slots;

a plurality of conductive members disposed in the slots respectively and configured for electrically connecting with corresponding pins of the jumper block, the non-conductive casing being mounted to the jumper block with the pins inserted into the slots respectively to connect with the conductive members; and a switch slidably disposed in the sliding groove and capable of selectively connecting two adjacent conductive members such that two corresponding adjacent pins of the jumper block connected with the two adjacent conductive members are electrically connected with each other via the switch and the two adjacent conductive members;

wherein the switch comprises a sliding block, a conductive sheet attached at a bottom surface of the sliding block, and a grip handle disposed at a top surface of the sliding block, the conductive sheet is attached at a bottom surface of the sliding block, an opening is defined in a top wall of the casing in communication with the sliding groove, and the sliding block is slidably accommodated in the sliding groove with the grip handle exposed from the opening of the casing.

12. The jumper device assembly as claimed in claim 11, wherein each of the conductive members comprises an upright connecting portion, two sidewalls extending perpendicularly from two sides of a lower portion of the connecting portion in a same direction and sandwiching a corresponding pin of the jumper block therebetween, two elastic slices extending up slantwise from the two sidewalls, and a top wall bent horizontally from a top edge of the connecting portion in the same direction with the two sidewalls configured to contact with the conductive sheet.

13. The jumper device as claimed in claim 12, wherein the slots of the casing are arranged in a line, the switch is movable along the line to selectively connect the conductive members at two adjacent slots of the casing.

14. The jumper device as claimed in claim 12, wherein the slots of the casing are arranged in a matrix of two rows by N columns, where N is a natural number equal to the number of slots divided by two, the switch is movable to selectively connect conductive members of any one of the N columns.

15. A jumper device configured for adjusting connections between a plurality of pins of a jumper block on a mainboard, comprising:

a non-conductive casing having a plurality of slots defined therein and communicating with outside at a bottom of the casing, and a sliding groove communicating tops of the slots, the slots configured for accommodating corresponding pins of the jumper block; and a switch comprising a conductive sheet slidably disposed in the sliding groove, the switch being slidable along the sliding groove to allow the conductive sheet of the switch selectively electrically connecting two corresponding pins of the jumper block, wherein each of the conductive members comprises an upright connecting portion, two sidewalls extending perpendicularly from two sides of a lower portion of the connecting portion in the same direction, two elastic slices extending up slantwise from the two sidewalls, and a top wall bent horizontally from a top edge of the connecting portion.

* * * * *